US011073018B1

(12) United States Patent
Knox et al.

(10) Patent No.: US 11,073,018 B1
(45) Date of Patent: Jul. 27, 2021

(54) SELF-DRILLING HYBRID ROCK ANCHOR

(71) Applicant: EPIROC DRILLING TOOLS AB, Fagersta (SE)

(72) Inventors: Greig Knox, Johannesburg (ZA); James William Sheppard, Johannesburg (ZA); Adrian Berghorst, Johannesburg (ZA)

(73) Assignee: EPIROC DRILLING TOOLS AB, Fagersta (SE)

( * ) Notice: Subject to any disclaimer, the term of this patent is extended or adjusted under 35 U.S.C. 154(b) by 0 days.

(21) Appl. No.: 17/051,558

(22) PCT Filed: May 3, 2019

(86) PCT No.: PCT/ZA2019/050024
§ 371 (c)(1),
(2) Date: Oct. 29, 2020

(87) PCT Pub. No.: WO2019/213675
PCT Pub. Date: Nov. 7, 2019

(30) Foreign Application Priority Data

May 3, 2018 (ZA) ..... 2018/02885
Sep. 21, 2018 (ZA) ..... 2018/06341

(51) Int. Cl.
*E21D 21/00* (2006.01)
*E21D 20/00* (2006.01)

(52) U.S. Cl.
CPC ..... *E21D 21/0053* (2016.01); *E21D 20/00* (2013.01); *E21D 21/004* (2013.01); *E21D 21/008* (2013.01); *E21D 21/0033* (2013.01)

(58) Field of Classification Search
CPC ..... E21D 21/0053; E21D 21/0033; E21D 21/004; E21D 21/008; E21D 21/0026; E21D 20/00
See application file for complete search history.

(56) References Cited

U.S. PATENT DOCUMENTS 6,648,557 B1 * 11/2003 Morrow ..... E21D 21/0026 405/259.1
2007/0269274 A1 * 11/2007 Seedsman ..... E21D 21/008 405/259.1

(Continued)

FOREIGN PATENT DOCUMENTS

AU 2015204352 2/2016
WO 2017/190397 11/2017

OTHER PUBLICATIONS

International Search Report for PCT/ZA2019/050024, dated Aug. 16, 2019, 4 pages.

(Continued)

*Primary Examiner* — Benjamin F Fiorello
(74) *Attorney, Agent, or Firm* — Nixon & Vanderhye

(57) ABSTRACT

A self-drilling rock anchor assembly includes: a friction fit tubular sleeve extending longitudinally between leading and trailing ends; a rod extending through the sleeve between first and second ends, and projecting from each sleeve end; a drill bit member engaged with the rod's first end having an exterior surface part of which tapers towards a back end of the member; a backstop element engaged with the rod's second end having a first drive surface; a load bearing element on the rod between the sleeve's trailing end and the backstop that has a second drive surface. The rod moves relative to the sleeve between a drill position, wherein the drill bit is spaced from the sleeve's leading end, and an insertion position, wherein the sleeve's leading end abuts the bit. The drill and insertion positions are achieved by applying a force to the first and second drive surfaces, respectively.

20 Claims, 2 Drawing Sheets

(56) References Cited

U.S. PATENT DOCUMENTS

| | | | | |
|---|---|---|---|---|
| 2008/0038068 | A1* | 2/2008 | Craig | E21D 21/008 405/259.3 |
| 2009/0074516 | A1* | 3/2009 | Craig | E21D 21/0053 405/259.1 |
| 2009/0114402 | A1 | 5/2009 | Mocivnik et al. | |
| 2011/0131787 | A1 | 6/2011 | Moroney et al. | |
| 2015/0204152 | A1 | 7/2015 | Boehm et al. | |
| 2017/0335537 | A1* | 11/2017 | Vasey | B63B 21/26 |
| 2018/0112529 | A1 | 4/2018 | McLaren | |
| 2020/0248552 | A1* | 8/2020 | Zhang | E21D 20/003 |

OTHER PUBLICATIONS

Written Opinion of the ISA for PCT/ZA2019/050024, dated Aug. 16, 2019, 5 pages.

* cited by examiner

SELF-DRILLING HYBRID ROCK ANCHOR

This application is the U.S. national phase of International Application No. PCT/ZA2019/050024 filed 3 May 2019, which designated the U.S. and claims priority to ZA Patent Application No. 2018/02885 filed 3 May 2018, and ZA Patent Application No. 2018/06341 filed 21 Sep. 2018, the entire contents of each of which are hereby incorporated by reference.

FIELD OF THE INVENTION

The invention relates to a self-drilling rock anchor.

BACKGROUND OF INVENTION

In ground conditions that are layered or laminated, it is difficult to install a rock bolt that is adapted to radially expand within a rock hole to frictionally fit therein. Such bolts typically have a diameter which is larger than the diameter of the drill hole into which it is inserted to radially compress when inserted and to expand into friction fit when fully inserted in the hole.

The reason for this is that, in such ground conditions, the drill hole begins to close after the drill steel is removed, making it difficult if not impossible to insert the friction fit anchor. In extreme cases, the closure occurs during the drilling operation, making it difficult, sometimes impossible, to retract the drill steel from the drill hole.

The invention at least partially solves the aforementioned problems.

SUMMARY OF INVENTION

The invention provides a self-drilling rock anchor assembly which includes:

a friction fit tubular sleeve which extends longitudinally between a leading end and a trailing end;

a rod which extends through the sleeve between a first end and a second end and which projects from each end of the sleeve;

a drill bit member engaged, or integral, with the first end of the rod having an exterior surface at least part of which tapers towards a back end of the member;

a backstop element engaged, or integral, with the second end of the rod having a first drive surface;

a load bearing element on the rod between the trailing end of the sleeve and the backstop element that has a second drive surface;

wherein the rod is moveable relatively to the sleeve between a drill position, in which the drill bit is spaced from the leading end of the sleeve, and an insertion position, in which the leading end of the sleeve abuts the drill bit; and wherein the drill position and the insertion position is achieved by applying a force to the first drive surface and the second drive surface respectively.

The friction fit tubular sleeve may have a longitudinally extending formation about which the body resiliently deforms.

The longitudinally extending formation may be a slit, longitudinal opening or a channel. The channel may be formed by indentation in a wall of the sleeve.

The rod may include a flushing bore which is longitudinally co-extensive with the rod and which opens at each of the first and second ends to provide a conduit for a flushing medium.

The assembly may include a load indicator on the trailing part of the rod between the backstop element and the load bearing element.

The assembly may include a supporting bush which inserts between the rod and the sleeve at the trailing end to keep the rock concentric to the sleeve.

The sleeve may include a wedge element engaged to the leading end of the sleeve and which is complementary to the exterior surface of the drill bit member.

The load bearing element may include a spherical seat.

The second drive surface may be a rear-facing surface of the load bearing element that faces the second end of the rod and that is adapted in lateral extension to receive force applied in an axial direction.

The backstop element may be a nut.

The first drive surface may be an end surface of the nut, adapted to receive the force applied in axial direction.

Alternatively, the first drive surface may be an outer circumferential surface of the nut, adapted to receive a force applied in a rotary direction.

The invention extends to a method of installing a rock anchor in support of a rock face which includes the steps of:

(a) providing the rock anchor which includes a friction fit tubular sleeve which extends longitudinally between a leading end and a trailing end, a rod which extends through the sleeve between a first end and a second end and which projects from each end of the sleeve, a drill bit member engaged, or integral, with the first end of the rod and having an exterior surface at least part of which tapers towards a back end of the member, a backstop element engaged, or integral, with the second end of the rod having a first drive surface and a load bearing element on the rod between the trailing end of the sleeve and the backstop element that has a second drive surface;

(b) engaging a face plate with the rock anchor;

(c) applying a rotary or percussive force to the first drive surface to cause the drill bit member to bore a hole into a rock face against which the drill bit member is applied;

(d) applying a percussive force to the second drive surface to move the sleeve relatively to the rod into the hole until the leading end of the sleeve abuts the drill bit member and a space is opened between the backstop element and the load bearing formation;

(e) applying a rotary or percussive force to the first drive surface to cause the drill bit formation to bore deeper into the hole and to move the rod relatively to the sleeve to close the space; and (f) alternating the repeat of steps (d) and (e) until the faceplate is engaged with the rock face in load bearing support, sandwiched between the rock face and the load bearing formation.

In a passive step that follows step (d), the drill bit member is drawn into the sleeve to wedge the sleeve into contact with the hole by action of rock face movement pushing on the faceplate.

The rod may include a flushing bore which is longitudinally co-extensive with the rod and which opens at each of the first and second ends.

The method may include the step of flushing the hole with a flushing fluid introduced through the flushing bore.

The friction fit tubular sleeve may have a longitudinally extending formation about which the body resiliently deforms.

The longitudinally extending formation may be a slit, longitudinal opening or a channel. The channel may be formed by indentation in a wall of the sleeve.

The assembly may include a load indicator on the trailing part of the rod between the backstop element and the load bearing element.

The assembly may include a supporting bush which inserts between the rod and the sleeve at the trailing end to keep the rock concentric to the sleeve.

The sleeve may include a wedge element engaged to the leading end of the sleeve and which is complementary to the exterior surface of the drill bit member.

The load bearing element may include a spherical seat.

The second drive surface may be a rear-facing surface of the load bearing element that faces the second end of the rod and that is adapted in lateral extension to receive force applied in an axial direction.

The backstop element may be a nut.

The first drive surface may be an end surface of the nut, adapted to receive the force applied in axial direction.

Alternatively, the first drive surface may be an outer circumferential surface of the nut, adapted to receive a force applied in a rotary direction.

BRIEF DESCRIPTION OF THE DRAWINGS

The invention is described with reference to the following drawings in which.

DESCRIPTION OF PREFERRED EMBODIMENTS

Figure 2:
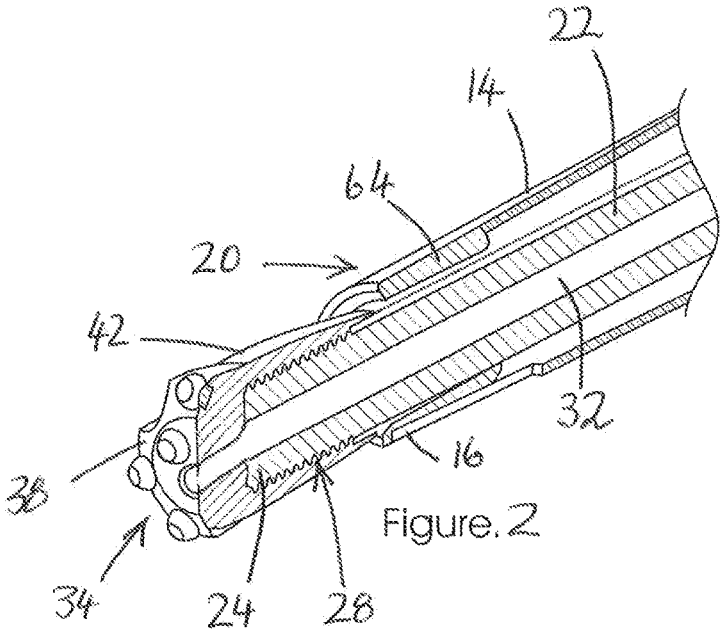
FIG. 2 is an isometric longitudinally sectioned view of a front-end of a self-drilling friction fit rock anchor assembly in accordance with the invention.
Figure 1:
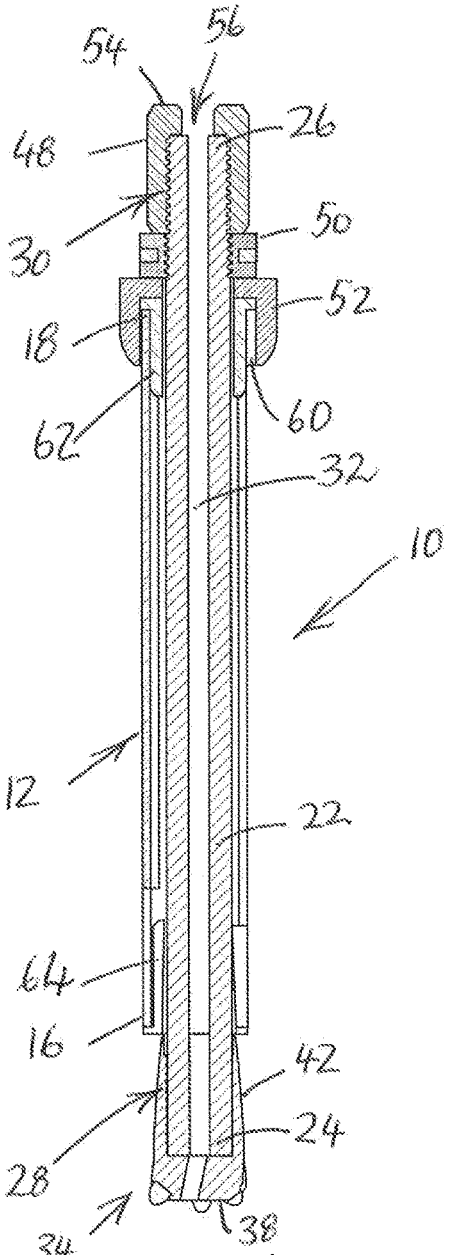
FIG. 1 is a view in longitudinal section of the rock anchor assembly in accordance with the invention.

A self-drilling friction fit rock anchor assembly 10 is illustrated in FIG. 1 of the accompanying drawings.

The rock anchor assembly 10 has an expansible sleeve 12 which has a generally tubular body 14 that longitudinally extends between a leading end 16 and a trailing end 18 (see FIG. 1). In this particular embodiment, the body has a slit (not shown) which extends the length of the body. It is about the slit that the sleeve accommodates radial compression and expansion to frictionally fit within a rock hole as will be more fully described below.

The feature of the slit is non-limiting and it is envisaged, within the scope of the invention, that a longitudinally extending formation about which the body is adapted to resiliently deform can be a channel or indented formation formed in a wall of the sleeve body 14.

The sleeve body 14 has a slightly tapered leading end portion 20 which tapers toward the leading end 16 to enable the sleeve, and the entire assembly 10, to be driven into the rock hole having a smaller diameter than the body. The wall of the sleeve body 12 is approximately 3 mm, made of structural grade steel or a composite material.

In the embodiment described above, the sleeve body 14 has a single wall. In an alternative embodiment, the sleeve body also can be made by longitudinally rolling a section of tube into a cross sectional C shape to provide a double walled structure.

The friction bolt assembly 10 further includes an elongate bored rod 22 which longitudinally extends between a first end 24 and a second end 26. In assembly, the rod is located partly within the sleeve and partly outside of the sleeve where it extends beyond a leading end 16 and trailing end 18 of the sleeve as a leading part 28 and trailing part 30 respectively. In this example, the rod is threaded, at least partially, along the leading part and the trailing part, as a means of attachment.

The rod has a flushing bore 32 which extends the length of the rod and opens at each of the ends (24, 26). It is through this bore that a flushing medium, such as water, is passed from the second end to flush a rock hole, drilled by the anchor assembly 10, of debris.

The assembly 10 includes a drill bit 34. The drill bit has a generally frusta-conical body 36 which includes a drill bit end 38 and an attachment end 40 and an outer generally frusta-conical surface 42 between the ends. See in particular FIG. 2A. The drill end 38 is of standard design, adapted to drill with back and forward hammering action. However, if the ground conditions dictate, the drill bit can be rotary operated.

Figure 2A:
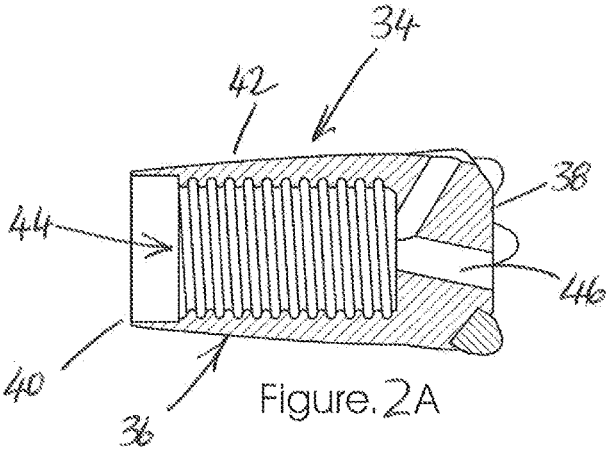
FIG. 2A is a longitudinally sectioned view of a drill bit of the assembly of FIG. 1.

A threaded aperture 44 penetrates the body 36 from the attachment end 40 (see FIG. 2A). The leading part 28 of the rod 22 engages the drill bit 34 by threaded engagement with the aperture. Flushing bore extensions 46 lead from the aperture, exiting at the drill bit end 38.

A significant part of the outer surface 42 tapers inwardly, with the taper ending at the attachment end 40.

With the drill bit end 38 and the taper of the outer surface 42, the drill bit 34 is adapted with dual functionality: to bore a hole and to wedge into the sleeve body 14 as will be described more fully below.

With reference to FIG. 1, the rock anchor assembly 10 further includes a closed end nut 48, a load indicator 50 and a spherical seat 52, all mounted on the trailing part 30 of the rod 22. The nut is threadingly engaged to the rod, at the second end 26. The nut has a blind end 54 which restrains the nut from travelling along the trailing part of the rod. The blind end only has a small diameter aperture 56 which is in register with the bore 36 for fluid communication.

Figures 3A, 3B, 3C, 3D:
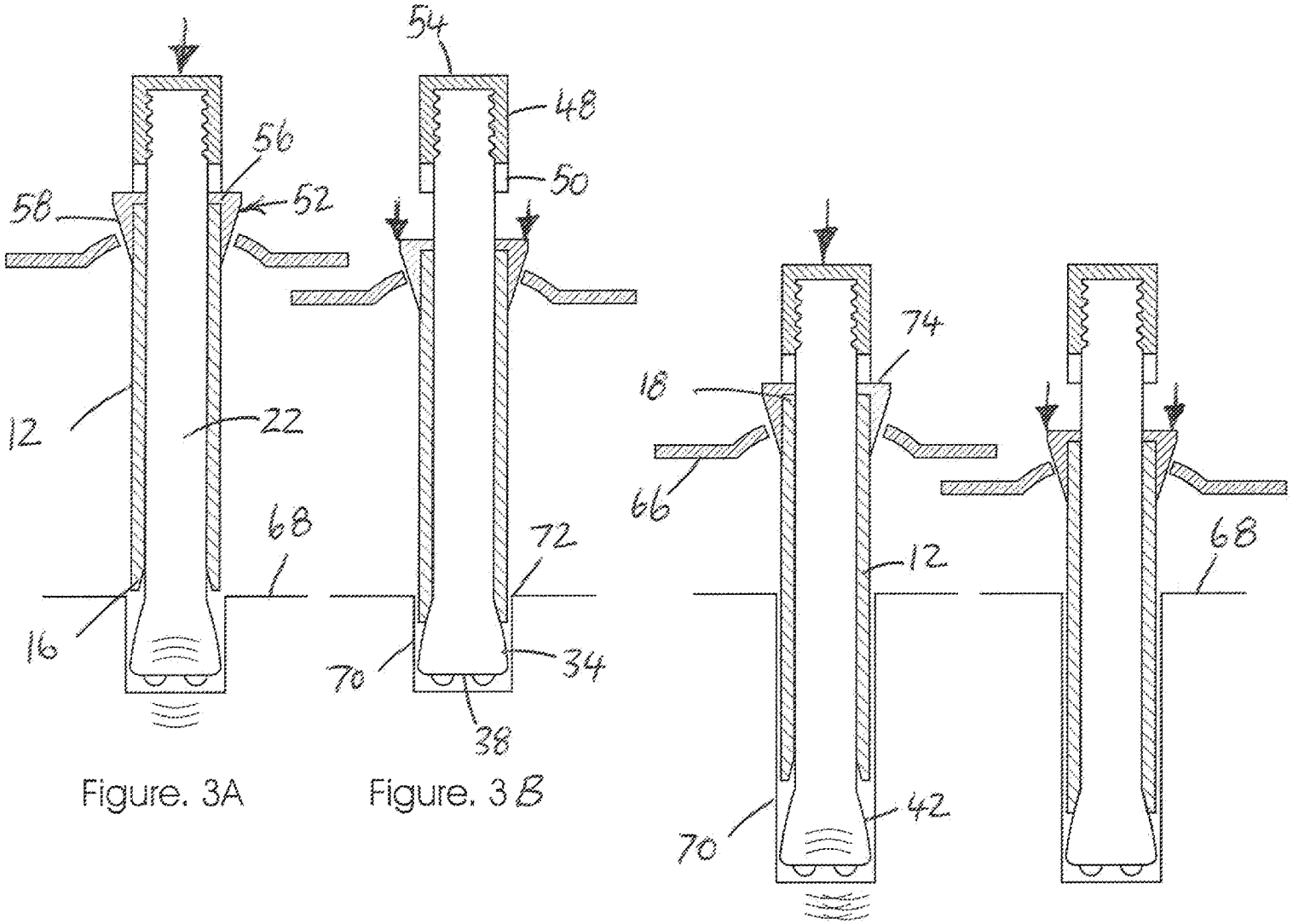
FIGS. 3A to 3D sequentially illustrate the forming of a rock hole by the rock anchor assembly and the installation of the rock anchor assembly into the rock hole.

The spherical seat 52 has a holed base 56 and a spherical wall 58 upstanding from the base (see FIG. 3A). A top edge of the wall is filleted to provide the "spherical seat" onto which a faceplate rests in use as will be described below and as illustrated in FIGS. 3A-3D. Enclosed by the base and the wall, a cup shaped recess 60 is defined (see FIG. 1). The seat engages with the rod 22 which is passed through the hole in the base. The seat is capable of axial movement along the trailing part 30 of the rod, confined between the sleeve 12 and the nut 48 or load indicator 50. When the seat is pushed against the trailing end 18 of the sleeve 12, a trailing end portion of the sleeve is frictionally received within the recess 58.

Finally, the assembly 10 includes a centralising support bush 72 and a circumferential wedge of leaves 64 which inserts into the trailing end 18 and leading end 16 of the sleeve respectively. The bush is supportive in function and prevents the sleeve from collapsing about this end portion when placed under load. The wedge of leaves engages with the outer surface 42 of the drill bit body 36 to provide an anchor to the rock anchor assembly 10.

With reference to FIGS. 3A to 3D, in use of the rock anchor assembly 10, a face plate 66 is engaged with the rock anchor assembly 10, passed over the assembly from the first end 24 of the rod, to abut the spherical seat 52.

The assembly 10 is installed using a mechanised drilling rig (not shown). Installed in a carousel or feeder of the rig, the assembly is presented to a rock face 68, with the drill end 38 of the drill bit 34 initially applied to the rock face.

A force (see directional arrow on FIG. 3A) is applied by the rig to the blind end 54 of the nut 48 in a percussive or hammering manner. The blind end provides a rod drive surface to which the force, which drives the rod incrementally forward, is applied. This force is rigidly transmitted through the rod to the drill end 38 of the drill bit 34 to bore a hole 70 into the rock face 68. This action is illustrated in FIG. 3A.

Periodic flushing of the hole is achieved by introducing a flushing medium through the small diameter aperture 56 of the nut 48, into the bore 32 and exiting the assembly 10 at the drill end 38 through the flushing bore extensions 46.

There comes a point in this operation when the leading end 16 of the sleeve arrives at a mouth 72 of the rock hole thus formed. At this stage a force (see directional arrow on FIG. 3B) is applied to a rear facing surface 74 of the base 56 of the spherical seat 52. This surface provides a sleeve drive surface.

Again, the force is applied in a percussive manner by the rig. This force pushes the sleeve forward, relatively to the rod 22, into the hole. As the hole has a smaller diameter than the sleeve, the sleeve body 14 compressively deforms, about the slit, to accommodate passage into the rock hole 70. This action, which is illustrated in FIG. 3B, opens a space between the spherical seat 52 and the nut 48 or load indicator 50. The leading end 16 of the sleeve is driven against the drill bit 34, moving over part the taper of the outer surface 42 but stopping short of causing the circumferential wedge of leaves 64 from expanding radially outwardly.

The drill action of FIG. 3A is then repeated to increase the depth of the hole 70. Here, the rod moves axially relatively to the sleeve, with the drill bit 34 disengaging from the sleeve 12.

The sleeve insertion step of FIGS. 3B and 3D alternates with the drill step of FIGS. 3A and 3C until the rock hole is deep enough to receive the anchor 10 to a point at which the face plate 66 engages the rock face 68 in load bearing support, sandwiched between the rock face and the nut 48, the load indicator 50 and spherical seat 52 train.

The rock anchor assembly 10 is capable of mechanically locking within the rock hole. This occurs after the active installation steps when there is inevitable movement of the rock face 68 outwardly into the excavation. This movement pushes on the face plate 66. With the face plate prevented in backward movement relatively to the rod 22, the rod is moved axially outwardly relatively to the sleeve, forcing the drill bit 34 into the sleeve. The tapered outer surface 42 of the drill bit body 36 wedges into the leaves 64 forcing the leaves radially outwardly and causing the sleeve 12 to frictionally contact with the rock hole 70. This is a passive occurrence and is not illustrated.

The self-drilling friction fit rock anchor assembly 10 of the invention fulfils the need for both increased efficiency, and automation in a mechanized mining development. The assembly is designed to fit onto a mining rig that can install the bolts without stopping mining, and with no need for a secondary operation. These units can be installed in a single operation, with no need for resin, or grout. The assembly is adapted to drill its own hole and thereafter is immediately able to carry load as soon as it is fully installed, with no need for additional operations.

A technical issue, which is overcome by the invention in the choice of material of manufacture, is the need for a hollow bar to flush the drilled rock out of the hole during insertion. However, as this hollow drill steel is to be used as the load bearing element, it needs to satisfy the strength and elongation properties enjoyed by support products and not that of standard off-the-shelf drill steel. Standard off-the-shelf drill steel is intended to efficiently drill multiple holes and as such is very hard and brittle (stiff); not ideal for rock support. Since the envisaged product merely has to drill one hole, the selected hollow drill steel's lack of drilling efficiency is sacrificed for improved elongation properties since this is its long term and primary design consideration.

The invention claimed is:

1. A self-drilling rock anchor assembly which includes a friction fit tubular sleeve which extends longitudinally between a leading end and a trailing end; a rod which extends through the sleeve between a first end and a second end and which projects from each end of the sleeve, a drill bit member engaged, or integral, with the first end of the rod and having an exterior surface at least part of which tapers towards a back end of the member; a backstop element engaged, or integral, with the second end of the rod having a first drive surface; a load bearing element on the rod between the trailing end of the sleeve and the backstop element that has a second drive surface; wherein the rod is moveable relatively to the sleeve between a drill position, in which the drill bit is spaced from the leading end of the sleeve, and an insertion position, in which the leading end of the sleeve abuts the drill bit; and wherein the drill position and the insertion position is achieved by applying a force to the first drive surface and the second drive surface respectively.

2. The self-drilling rock anchor assembly according to claim 1 wherein the rod includes a flushing bore which is longitudinally co-extensive with the rod and which opens at each of the first and second ends.

3. The self-drilling rock anchor assembly according to claim 2 which includes a supporting bush which inserts between the rod and the sleeve.

4. The self-drilling rock anchor assembly according to claim 2, further comprising a wedge element engaged to the leading end of the sleeve and which is complementary to the exterior surface of the drill bit member.

5. The self-drilling rock anchor assembly according to claim 2, wherein the load bearing element includes a spherical seat.

6. The self-drilling rock anchor assembly according to claim 2, wherein the second drive surface is a rear-facing surface of the load bearing element.

7. The self-drilling rock anchor assembly according to claim 1 which includes a supporting bush which inserts between the rod and the sleeve.

8. The self-drilling rock anchor assembly according to claim 7, further comprising a wedge element engaged to the leading end of the sleeve and which is complementary to the exterior surface of the drill bit member.

9. The self-drilling rock anchor assembly according to claim 7, wherein the load bearing element includes a spherical seat.

10. The self-drilling rock anchor assembly according to claim 7, wherein the second drive surface is a rear-facing surface of the load bearing element.

11. The self-drilling rock anchor assembly according to claim 1, further comprising a wedge element engaged to the leading end of the sleeve and which is complementary to the exterior surface of the drill bit member.

12. The self-drilling rock anchor assembly according to claim 11, wherein the load bearing element includes a spherical seat.

13. The self-drilling rock anchor assembly according to claim 11, wherein the second drive surface is a rear-facing surface of the load bearing element.

14. The self-drilling rock anchor assembly according to claim 1, wherein the load bearing element includes a spherical seat.

15. The self-drilling rock anchor assembly according to claim 14, wherein the second drive surface is a rear-facing surface of the load bearing element.

16. The self-drilling rock anchor assembly according to claim 1, wherein the second drive surface is a rear-facing surface of the load bearing element.

17. The self-drilling rock anchor assembly according to claim 1, wherein the backstop element is a nut.

18. The self-drilling rock anchor assembly according to claim 17 wherein the first drive surface is an end surface of the nut, adapted to receive the force applied in axial direction.

19. The self-drilling rock anchor assembly according to claim 17 wherein the first drive surface is an outer circumferential surface of the nut, adapted to receive a force applied in a rotary direction.

20. A method of installing a rock anchor in support of a rock face which includes the steps of:

(a) providing the rock anchor which includes a friction fit tubular sleeve which extends longitudinally between a leading end and a trailing end, a rod which extends through the sleeve between a first end and a second end and which projects from each end of the sleeve, a drill bit member engaged, or integral, with the first end of the rod and having an exterior surface at least part of which tapers towards a back end of the member, a backstop element engaged, or integral, with the second end of the rod having a first drive surface and a load bearing element on the rod between the trailing end of the sleeve and the backstop element that has a second drive surface;

(b) engaging a face plate with the rock anchor;

(c) applying a rotary or percussive force to the first drive surface to cause the drill bit member to bore a hole into a rock face against which the drill bit member is applied;

(d) applying a percussive force to the second drive surface to move the sleeve relatively to the rod into the hole until the leading end of the sleeve abuts the drill bit member and a space is opened between the backstop element and the load bearing formation;

(e) applying a rotary or percussive force to the first drive surface to cause the drill bit formation to bore deeper into the hole and to move the rod relatively to the sleeve to close the space; and (f) alternating the repeat of steps (d) and (e) until the faceplate is engaged with the rock face in load bearing support, sandwiched between the rock face and the load bearing formation.

* * * * *